United States Patent [19]
Webb
[11] 4,304,318
[45] Dec. 8, 1981

[54] LADDER LEVELLING SYSTEM

[76] Inventor: Allie E. Webb, 90 Burnett Way, Alpharetta, Ga. 30201

[21] Appl. No.: 170,842

[22] Filed: Jul. 21, 1980

[51] Int. Cl.³ ..... E06C 7/44
[52] U.S. Cl. ..... 182/107; 182/200; 248/188.2
[58] Field of Search ..... 182/107, 108, 200; 248/188.2

[56] References Cited

U.S. PATENT DOCUMENTS

| | | | |
|---|---|---|---|
| 330,911 | 11/1885 | Livingston | 248/188.2 |
| 3,021,638 | 2/1962 | Kristek | 248/188.2 |
| 3,993,275 | 11/1976 | Lucas | 182/107 |
| 4,069,890 | 1/1978 | Gottliebsen | 182/108 |
| 4,199,123 | 4/1980 | Weber | 248/188.2 |

FOREIGN PATENT DOCUMENTS

| | | | |
|---|---|---|---|
| 1247577 | 8/1967 | Fed. Rep. of Germany | 248/188.2 |

*Primary Examiner*—Reinaldo P. Machado
*Attorney, Agent, or Firm*—Louis T. Isaf

[57] ABSTRACT

A ladder levelling device used in combination with a ladder on inclined ground surfaces, which levelling device is placed under one leg of the ladder while the other leg rests on the ground surface or some other support, comprises a triangular, inclined platform including an open cavity area defined in its bottom side. The levelling device provides a stable, as well as a level ladder.

6 Claims, 3 Drawing Figures (TOP PERSPECTIVE VIEW)

(BOTTOM PERSPECTIVE VIEW)

LADDER LEVELLING SYSTEM

FIELD OF THE INVENTION

The present invention relates generally to the field of ladders and more specifically to accessories for levelling a ladder.

BACKGROUND OF THE INVENTION

The ladder is a useful tool, but for years the typical ladder has posed problems for those who found it necessary to set up on an inclined ground surface. It is difficult and even dangerous to climb a ladder when the steps are tilted at an angle. Users have tried many things to balance the uphill and downhill legs. For example, a user will scurry quickly up the ladder while clinging to the uphill leg, or place rocks under the downhill leg. More ingenous ladder manufacturers have provided extendable legs which can be adjusted to vary the relative lengths of the legs. Most of the methods, however, appear to have been impractical, dangerous or expensive.

SUMMARY OF THE INVENTION

Briefly described, the present invention comprises an inclined, triangular platform assembly for use in combination with a typical ladder to shore up a leg of the ladder, thus allowing the ladder to set level on an inclined ground surface. The inclined orientation of the platform provides a shim of varying heights to fill in gaps of various heights between the leg of the level ladder and the inclined ground surface. In its preferred embodiment, the platform assembly includes a platform surface which is triangular in shape in an effort to provide stability to the ladder regardless of the positioning of the leg on the platform.

Furthermore, in the preferred embodiment, the platform assembly comprises two side walls which define an open space between them. Such open space is intended to add stability to the platform and ladder in areas of rough and uneven terrain.

It is, therefore, an object of the present invention to provide a ladder levelling device which is inexpensive, stable and easy to use.

Another object of the present invention is to provide a stable, inclined surface for use in combination with a ladder or like device to level the ladder on uneven ground surfaces.

Yet another object of the present invention is to provide a ladder levelling device which is light weight and portable.

Other objects, features and advantages of the present invention will be apparent upon reading and understanding the remaining specification, when taken in conjunction with the accompanying drawing.

DETAILED DESCRIPTION OF PREFERRED EMBODIMENT

Figure 1:
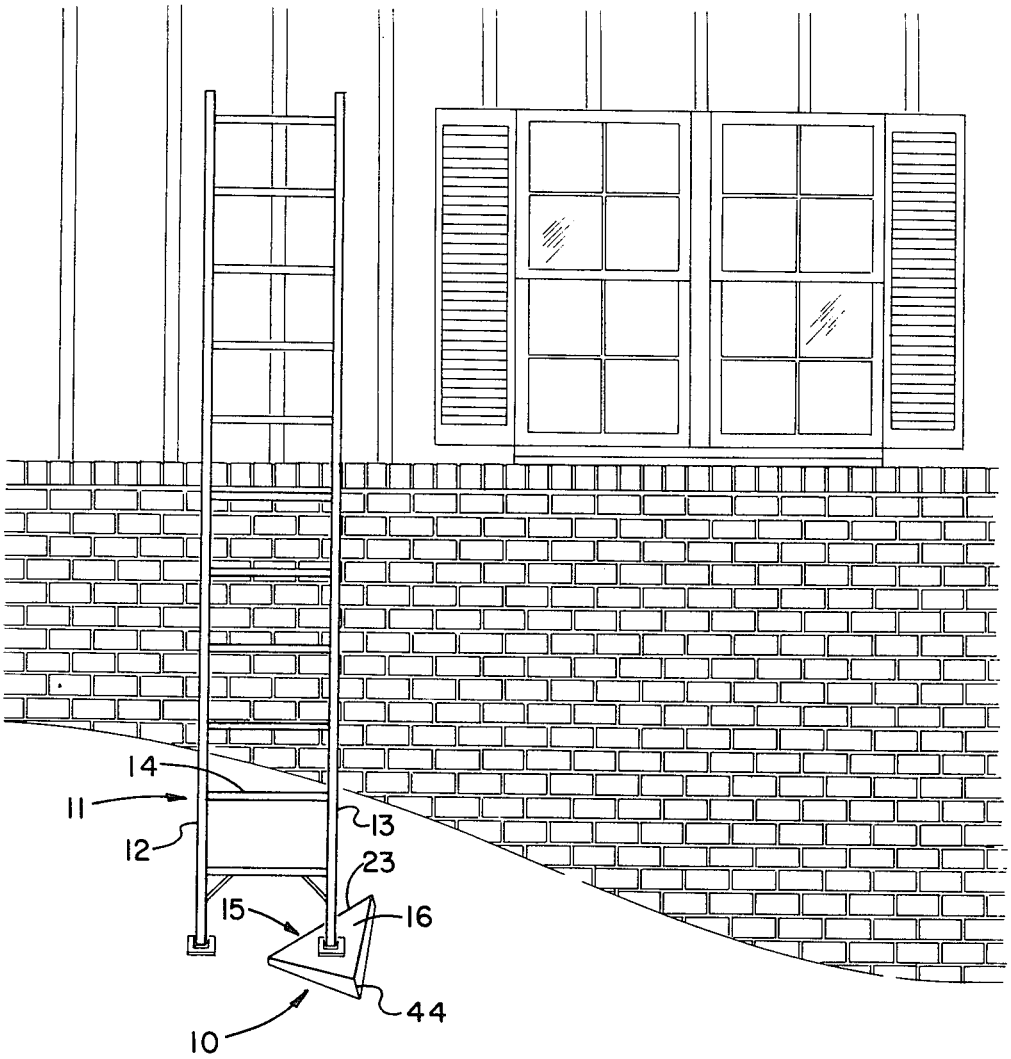
FIG. 1 is a pictorial view of the combination of the present invention including a ladder and the ladder levelling device.
Figure 2:
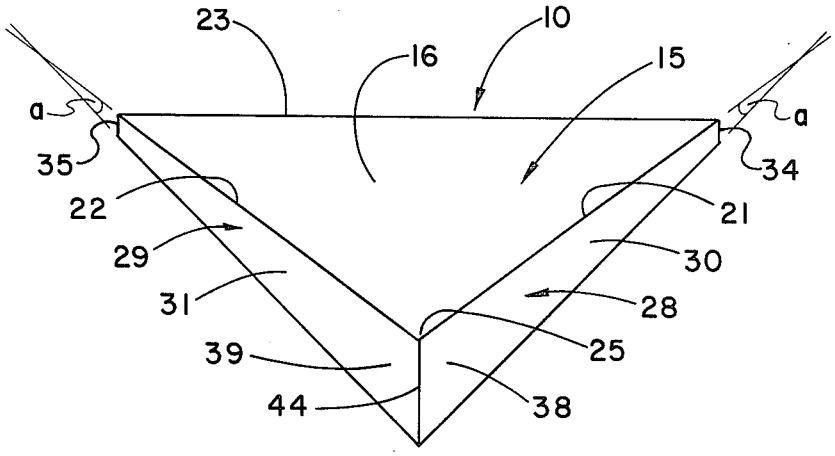
FIG. 2 is a perspective view of the ladder levelling device of the present invention, taken generally from the top.
Figure 3:
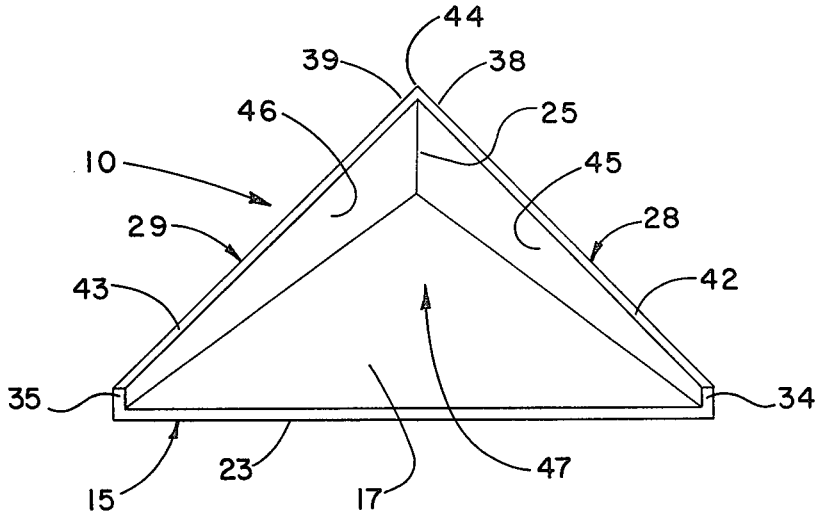
FIG. 3 is a perspective view of the ladder levelling device of the present invention, taken generally from the bottom.

Referring now in greater detail to the drawings in which like numerals represent like components throughout the several views, FIG. 1 shows the ladder levelling device 10 of the present invention as used in combination with a ladder 11. The ladder 11 includes, in this case, two legs 12, 13 and a plurality of steps 14. The ladder levelling device 10 comprises a platform 15 which includes a flat upper surface 16 and a lower surface 17. (see FIGS. 1 and 2.) The platform 15 is triangular in shape having three edges 21, 22, and 23. In the preferred embodiment, the triangle formed by the platform 15 is a right triangle including a right angle 25.

The levelling device 10 further includes two side walls 28, 29, which extend perpendicular to the upper surface 16 of the platform 15 from the lower surface 17. One side wall 28 is aligned adjacent one edge 21 of the platform 15. The other side wall 29 is aligned adjacent a second edge 22 of the platform 15. Each side wall 28, 29 includes an outer face 30, 31, a short end 34, 35, a tall end 38, 39, and bottom edge 42, 43. The bottom edge 42, 43 of each side wall 28, 29 is inclined relative to the upper surface 16 of the platform 15. The angle of inclination (a) of the bottom edge 42, 43 relative to the upper surface 16 varies as a matter of design choice. Preferably, the tall ends 38, 39 of the two side walls 28, 29 abut each other to form a corner 44 and the two outer faces 30, 31 are perpendicular to one another.

The lower surface 17 of the platform 15 of the preferred embodiment is generally parallel to upper surface 16 of the platform or only slightly sloped relative to the upper surface as compared to the angle of inclination (a) of the bottom edges 42, 43 of the side walls 28, 29. The two side walls 28, 29 include inner faces 45, 46 which, together with the lower surface 17 of the platform 15, define an open cavity area 47 among them. In operation, the ladder levelling device 10 of the present invention is used in combination with a ladder 11, or a chair, or other similar object 11, which is being set up on an inclined ground surface. The user sets up the ladder 11 with the uphill leg 12 of the ladder resting on the ground surface or on some third means of support. The user then places the levelling device 10 under the downhill leg 13 of the ladder 11. The downhill leg 13 rests on the upper surface 16 of the platform 15 of the levelling device 10. With the leg 13 on the platform 15, the user slides the levelling device 10 up the inclined ground surface, gradually raising the downhill leg 13, until the ladder steps 14 are approximately horizontal. In the event that a four legged ladder or chair is being used, it would be within the scope of this invention to place one levelling device 10 under each of the downhill legs.

Generally, the levelling device 10 is oriented on the ground surface with the tall corner 44 directed downhill and the edge 23 facing uphill. The orientation of the device 10 is varied to compensate for uneven slopes or otherwise to stabilize the device 10 and thus the ladder 11. To avoid knobs, rocks and other obstructions of the ground surface, the device 10 is moved about to miss the obstructions or to straddle the obstructions within the open cavity area 47, thus preventing wabbling of the device 10.

The ladder leg 13 is set up on any portion of the upper surface 16 of the platform 15. As an added feature, if the slope of the inclined ground surface is too slight to set up the leg 13 on the upper surface 16, the device 10 is turned upside down and the leg is shimmed up resting on the lower platform surface 17 within the open cavity area 47. The natural thickness of the platform 15 raises the ladder leg 13 a short distance. A slight incline in the bottom surface 17 relative to the upper surface 16 of the platform 15 provides an excellent shim.

While this invention has been described in specific detail with particular reference to preferred embodiments thereof, it will be understood that variations and modifications can be effected within the spirit and scope of the invention as described hereinbefore and as defined in the appended claims.

I claim:

1. In combination with a ladder or like device including at least two leg members, a ladder levelling device for insertion between one of the leg members and an inclined ground surface, said ladder levelling device comprising;

a triangular leg member support platform, said support platform including three side edges, a flat upper surface, and a flat lower surface;

a first side wall extending generally perpendicular to said upper surface from said lower surface of said support platform adjacent one of said three side edges, said first side wall including a short end, a tall end and a bottom edge, said bottom edge defining a plane forming an accute angle with a plane defined by said upper surface of said support platform; and a second side wall extending generally perpendicular to said upper surface from said lower surface of said support platorm adjacent a second of said three side edges, said second side wall including a short end, a tall end and a bottom edge, said bottom edge defining a plane forming an accute angle with the plane defined by said upper surface of said support platform.

2. Combination of claim 2, wherein said flat upper surface of said support platform defines a right triangle, and said first side wall defines a plane extending generally perpendicular to a plane defined by said second side wall.

3. Combination of claim 2, wherein said lower surface of said support platform extends parallel to said upper surface of said support platform.

4. A ladder levelling device, comprising;

a triangular ladder support member including a flat upper surface and a flat lower surface; and a first and second side wall, each said side wall extending from said lower surface of said support member, and including a short end, a tall end, and a bottom edge, whereby said upper surface of said support member defines an acute angle with a level ground surface when said side walls are placed with their bottom edges on the level ground surface.

5. Device of claim 4, wherein said first side wall and said second side wall are arranged perpendicular to one another with their respective tall ends in abutment.

6. A ladder levelling device for insertion between one of the leg members of a ladder or like device and an inclined ground surface, said levelling device comprising:

a triangular leg member support platform, said support platform including three side edges, a flat triangular upper surface, and a flat lower surface;

a first side wall extending generally perpendicular to said upper surface from said lower surface of said support platform adjacent one of said three side edges, said first side wall including a short end, a tall end, and a bottom edge, said bottom edge defining a plane forming an accute angle with a plane defined by said upper surface of said support platform; and a second side wall extending generally perpendicular to said upper surface from said lower surface of said support platform adjacent a second of said three side edges, said second side wall including a short end, a tall end and a bottom edge, said bottom edge defining a plane forming an accute angle with the plane defined by said upper surface of said support platform.

* * * * *